US006945169B2

(12) United States Patent
Göttling et al.

(10) Patent No.: US 6,945,169 B2
(45) Date of Patent: Sep. 20, 2005

(54) APPARATUS FOR PRODUCING PRINTING PLATES

(75) Inventors: Josef Göttling, Friedberg (DE); Thomas Hartmann, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 213 days.

(21) Appl. No.: 09/973,590

(22) Filed: Oct. 9, 2001

(65) Prior Publication Data

US 2002/0040653 A1 Apr. 11, 2002

(30) Foreign Application Priority Data

Oct. 6, 2000 (DE) ..... 100 49 576

(51) Int. Cl.[7] ..... B41F 13/24

(52) U.S. Cl. ..... 101/248; 101/486; 101/150; 101/220; 101/247; 101/216

(58) Field of Search ..... 101/248, 486, 101/220, 247, 216, 415.1, 463.1, 465, 467

(56) References Cited

U.S. PATENT DOCUMENTS

| | | | | | |
|---|---|---|---|---|---|
| 4,438,697 | A | * | 3/1984 | Doliner | 101/183 |
| 4,913,048 | A | * | 4/1990 | Tittgemeyer | 101/141 |
| 5,188,027 | A | * | 2/1993 | Fantoni | 101/216 |
| 5,666,188 | A | * | 9/1997 | Chmielnik | 355/40 |
| 5,687,647 | A | * | 11/1997 | Vrotacoe et al. | 101/375 |
| 5,760,880 | A | * | 6/1998 | Fan et al. | 355/67 |
| 5,784,961 | A | * | 7/1998 | Lorig et al. | 101/375 |
| 5,802,975 | A | * | 9/1998 | Prem et al. | 101/375 |
| 5,832,821 | A | * | 11/1998 | Petersen et al. | 101/216 |
| 5,943,955 | A | * | 8/1999 | Niemiro et al. | 101/216 |
| 5,960,714 | A | * | 10/1999 | Gottling et al. | 101/216 |
| 6,030,750 | A | * | 2/2000 | Vermeersch et al. | 430/302 |
| 6,070,528 | A | * | 6/2000 | Fleischmann et al. | 101/170 |
| 6,085,650 | A | * | 7/2000 | Petersen | 101/220 |
| 6,112,664 | A | * | 9/2000 | Naniwa et al. | 101/463.1 |
| 6,138,566 | A | * | 10/2000 | Sakamoto | 101/463.1 |
| 6,186,065 | B1 | * | 2/2001 | Kersch et al. | 101/216 |
| 6,186,068 | B1 | * | 2/2001 | Gelbart | 101/486 |
| 6,308,627 | B1 | * | 10/2001 | Konig et al. | 101/425 |
| 6,357,354 | B1 | * | 3/2002 | Dauer et al. | 101/477 |
| 6,397,743 | B1 | * | 6/2002 | Dauer et al. | 101/220 |
| 6,457,414 | B1 | * | 10/2002 | Kato et al. | 101/477 |

FOREIGN PATENT DOCUMENTS

| | | | |
|---|---|---|---|
| DE | 43 41 246 | 2/1995 | B41F/13/10 |
| DE | 196 24 394 | 12/1997 | B41F/13/008 |
| DE | 196 24 441 | 12/1997 | B41C/1/05 |
| DE | 198 46 509 | 6/1999 | B41C/1/055 |
| DE | 198 45 711 | 4/2000 | B41F/27/12 |

OTHER PUBLICATIONS

Office Action dated Apr. 15, 2005 from corresponding Canadian Patent Application No. 2,358,410.

* cited by examiner

*Primary Examiner*—Daniel J. Colilla
*Assistant Examiner*—Andrea H. Evans
(74) *Attorney, Agent, or Firm*—Cohen, Pontani, Lieberman & Pavane

(57) ABSTRACT

Apparatus for producing printing plates in particular a blank sleeve-like printing plate, includes a cylinder carrier for receiving a printing plate, the cylinder carrier being held in cantilever fashion at one end in a frame in a mounting and is driven by a motor, it being possible for the printing plate to be pushed onto the carrier cylinder at an opposite side of the latter which faces away from the mounting and is, therefore, more accessible for making printing plate exchange. An image-setting device is moved along the carrier cylinder.

14 Claims, 5 Drawing Sheets

APPARATUS FOR PRODUCING PRINTING PLATES

BACKGROUND OF THE INVENTION

1. Field of the Invention

The invention relates to an apparatus for producing printing plates, in which a printing plate on which an image is to be set is arranged on a carrier cylinder and, during rotation of the carrier cylinder, has an image set on it by an image-setting device that can be moved along the carrier cylinder.

2. Description of the Related Art

An apparatus is known in which a cylinder on which an image is to be set is clamped into tailstocks on a guide bed. A gravure printing plate is engraved into this cylinder by means of an image-setting device in the form of an electronically controlled gouge. In order to remove the cylinder, at least on tailstock has to be moved laterally. This requires a great deal of space, in particular when removing a sleeve-like printing plate. In addition, the change is time consuming and awkward.

SUMMARY OF THE INVENTION

It is the object of the invention to provide an apparatus for producing printing plates in which a printing plate, in particular a sleeve-like printing plate, can be changed with little effort and with a low space requirement.

According to the invention, the object is achieved by apparatus which includes a frame, a mount in the frame, and a carrier cylinder cantilever mountable at an end thereof to the mounting. A motor is provided for driving the carrier cylinder. An image setting device for setting an image on a blank printing plate is provided, the blank printing plate being arranged on the carrier cylinder. The image setting device is moveable along the carrier cylinder during setting of the image. An opposite end of the carrier cylinder is freely accessible to permit printing plate change on the carrier cylinder.

The apparatus makes it possible to push a printing plate axially onto or off the carrier cylinder quickly and in a space-saving manner. By virtue of the cantilevered mounting of the carrier cylinder, which is accessible on one side, the change is readily possible. Overall, preconditions for setting an image rapidly on the printing plate are provided.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
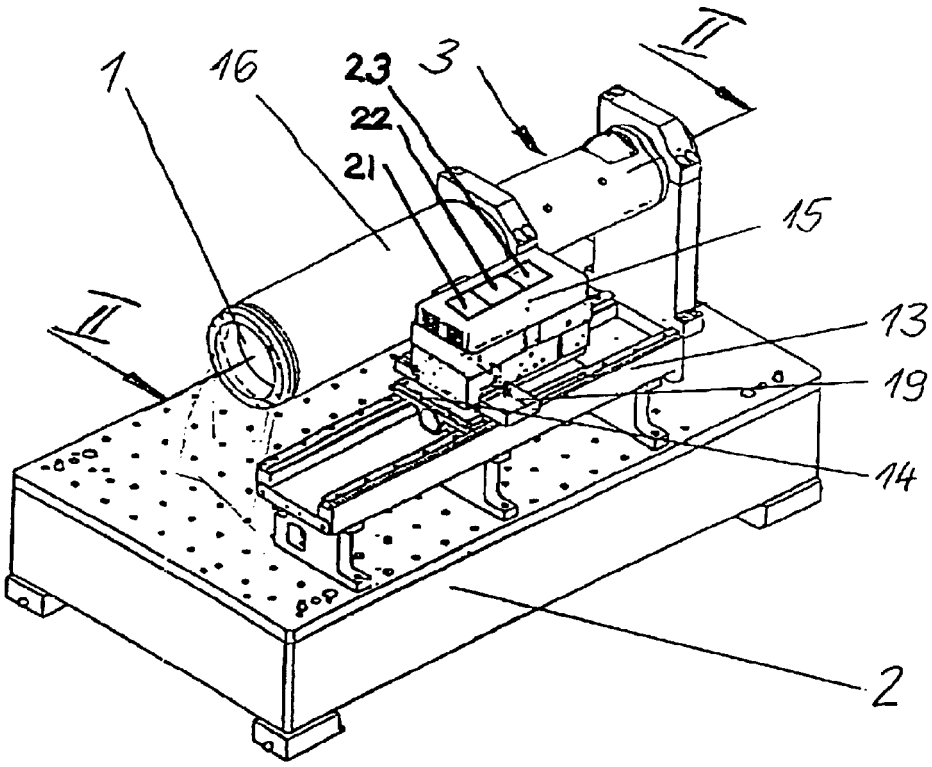
FIG. 1 is a perspective view of apparatus for producing a printing plate in accordance with the invention.
Figure 2:
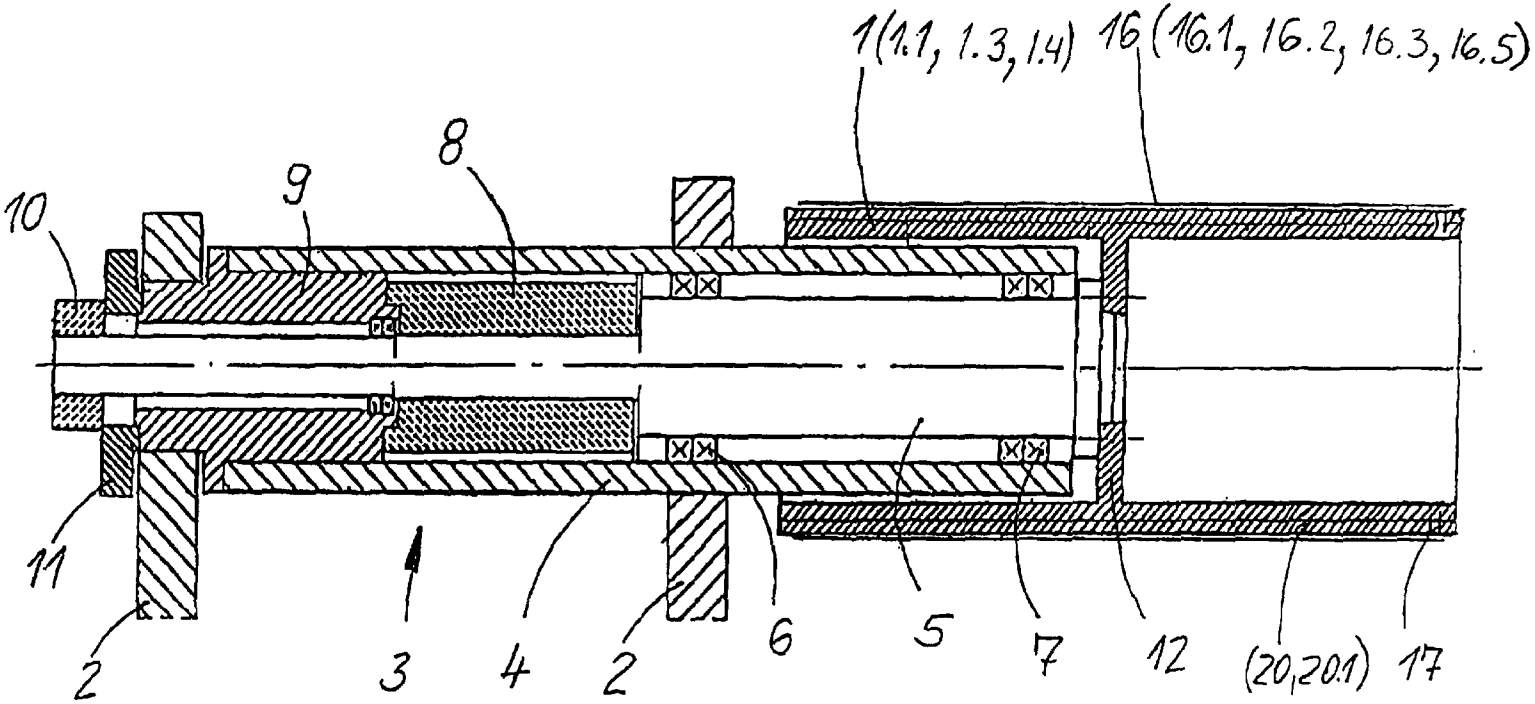
FIG. 2 is a sectional view taken along line II—II in FIG. 1.

The apparatus shown in FIG. 1 for producing printing plates contains a carrier cylinder 1, which is cantilever-mounted in a mounting 3 arranged in a frame 2. In detail, FIG. 2 shows that the mounting 3 contains a carrying tube 4, in which a spindle 5 connected to the carrier cylinder 1 is mounted in rolling-contact bearings 6, 7. Also accommodated in the carrying tube 4 is a motor 8 that drives the carrier cylinder 1. The motor is advantageously designed as a kit motor and fixed to the spindle 5. In the carrying tube 4, the motor 8 is supported via a sleeve 9. A rotary encoder 10 is also advantageously fixed to the spindle 5, being supported on a lever 11 fixed to the sleeve 9. The carrier cylinder 1 can also be driven by a motor fixed in the frame 2, via an external flexible drive, for example a toothed belt.

Figure 4:
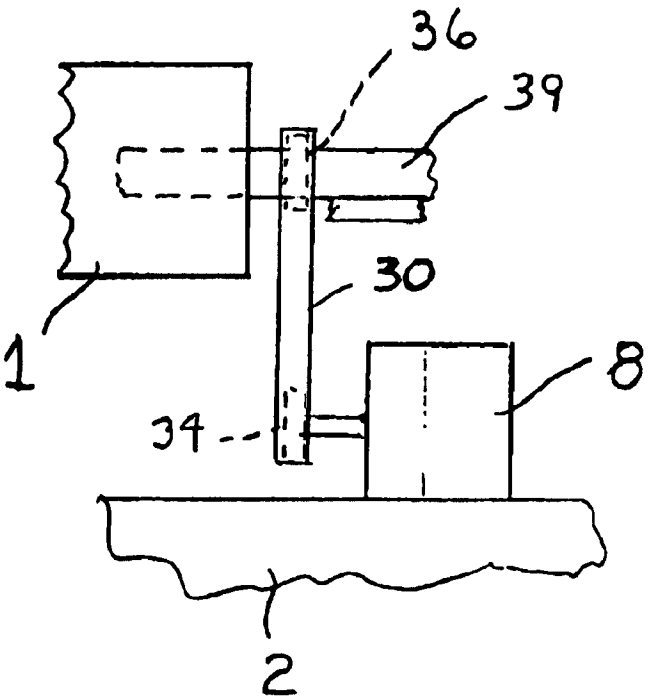
FIG. 4 is a fragmentary schematic view depicting an external flexible drive for connecting the drive motor to a journal of the carrier cylinder when the drive motor is located in the frame.

An example of the external flexible drive arrangement is depicted in FIG. 4. Motor 8 is mounted to frame 2. A toothed belt 30 runs around toothed gear 34 on the motor and toothed gear 36 on the journaled part 39 of the carrier cylinder spindle and thereby transmits drive to the carrier cylinder from the motor.

The carrier cylinder 1 is screwed to one end of the spindle 5 protruding out of the carrying tube 4 (FIG. 2). To this end, it bears a base 12 which has an internal cone which is paired with an external cone on the spindle 5. The fitting of the carrier cylinder 1 could instead also be carried out by means of a force fit or Hirth toothing. The base 12 of the carrier cylinder is arranged approximately at its centre. This achieves stable, low-vibration mounting of the carrier cylinder 1.

The frame 2 further accommodates a crossmember 13, which is arranged parallel to the axis of rotation of the carrier cylinder 1. A carriage 14, to which an image-setting device 15 is fixed, can be moved on the crossmember 13.

A sleeve-like printing plate 16 can be pushed onto the carrier cylinder 1 from the freely accessible end. To assist or permit the pushing-on action, air is blown from holes 17 against the inner wall of the printing plate 16, by which means the latter is expanded elastically. Possible ways of feeding compressed air are indicated in the Patent Application DE 199 61 866.6. Then, by means of activating and moving the image-setting device 15 on the crossmemeber 13 along the carrier cylinder 1, and also rotating the carrier cylinder 1 by driving it by means of the motor 8, the sleeve-like printing plate 16 has an image set on it. In the exemplary embodiment, the sleeve-like printing plate 16 is an offset printing plate which, for example, has an image set on it in accordance with the process described in DE 198 11 029 A1. However, a flexographic printing plate 16.1 which, for example, has an image set on it in accordance with a process according to DE 43 42 954 C2, or a gravure printing plate 16.2 which, for example, has an image set in accordance with a process according to DE 196 24 441 C1, can also be arranged on the carrier cylinder 1.

Figure 3:
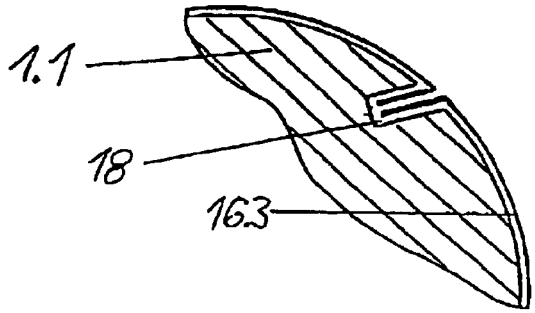
FIG. 3 is a fragmentary section view showing a clamping device with which printing plates can be arranged on the carrier cylinder.

Finite printing plates 16.3 can also be arranged on a carrier cylinder 1.1 if the carrier cylinder 1.1 has an appropriate clamping device 18. A slot-like clamping device 18 of this type is shown as an example in FIG. 3. If appropriate, a sleeve-like printing plate 16 can also be clamped onto a carrier cylinder 1.1 equipped with the clamping device 18. The finite printing plate 16.3 can be changed from the freely accessible end of the carrier cylinder 1.1 by being pushed on or pulled off axially. If appropriate, when the carrier cylinder 1.1 is equipped with a suitable clamping device 18, a finite printing plate 16.3 can also be guided radially to the carrier cylinder 1.1 and away from it.

Figure 5:
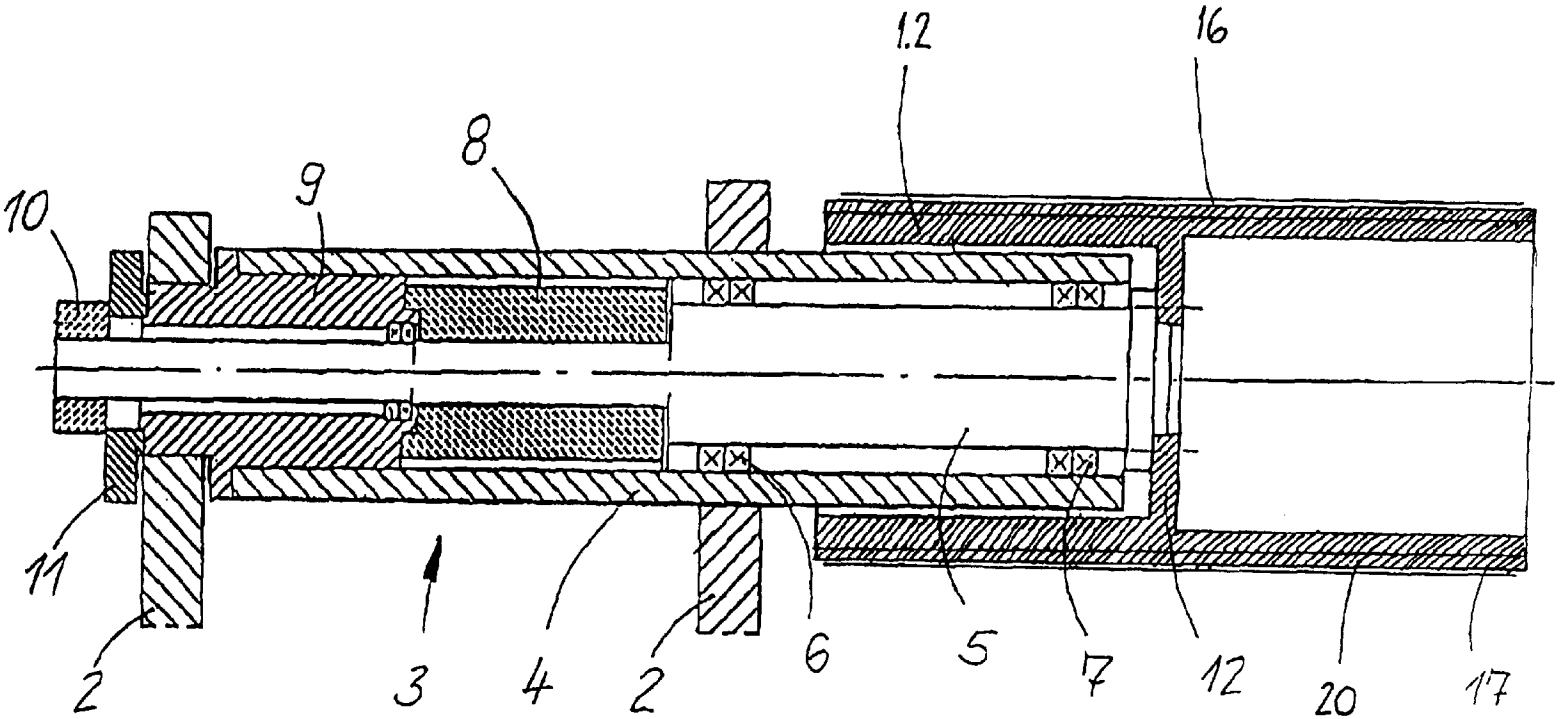
FIG. 5 is a view similar to that of FIG. 2 with a carrier cylinder having a larger diameter than that shown in FIG. 2.

The carrier cylinder 1 can also be replaced by a carrier cylinder 1.2 of a different diameter (see FIG. 5), which means that printing plates 16.4 of different formats can have images set on them by the image-setting device. Depending on the diameter of the carrier cylinder 1, 1.2, the image-setting device is moved radially towards the carrier cylinder 1 or 1.2 or away from the latter. The carriage 14 has a transverse support 19 for this purpose and is designed as a cross slide, as it is known.

Figure 6:
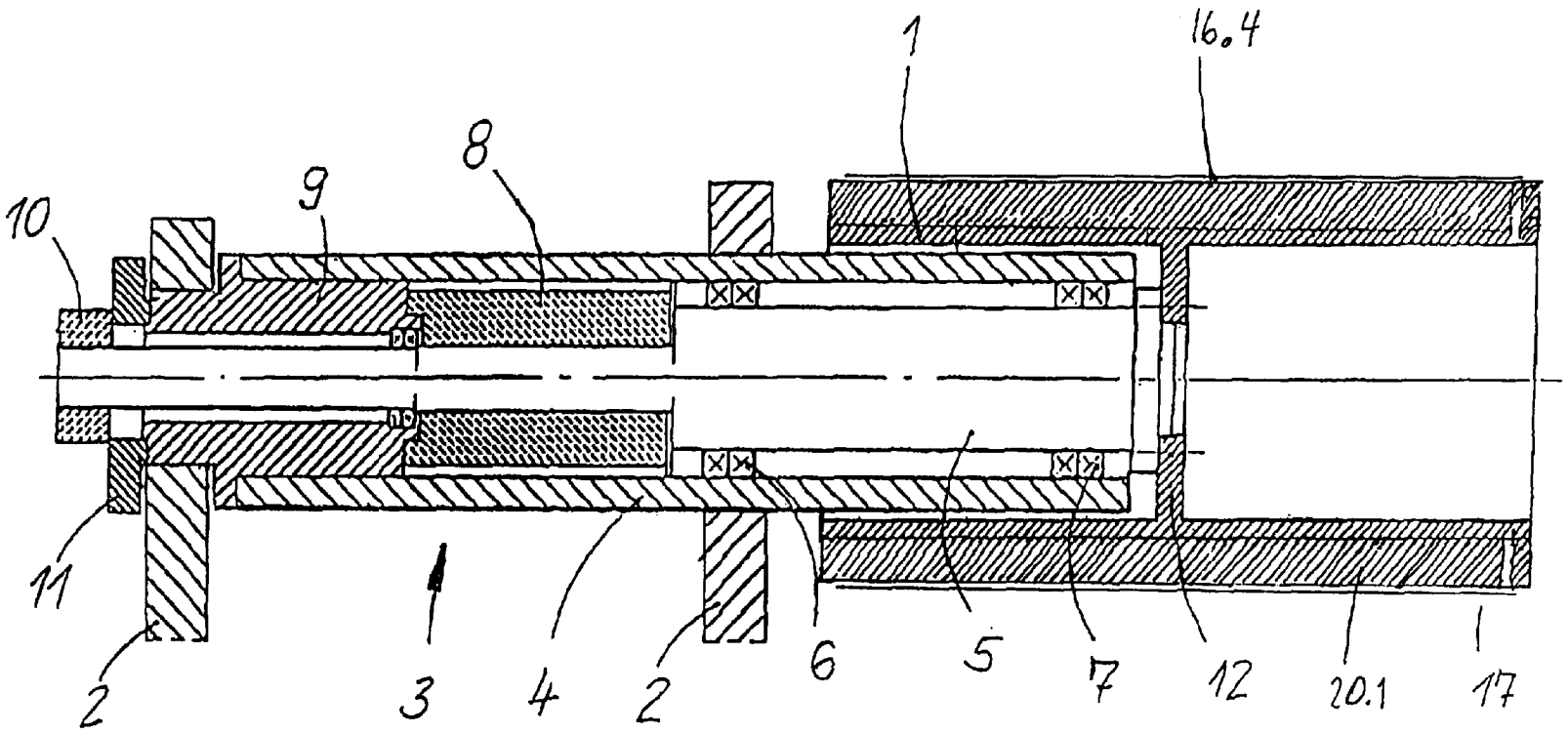
FIG. 6 is a view similar to that of FIG. 2 with an intermediate sleeve having a different diameter than that of FIG. 2.

Printing plates 16.4 of different formats can also be clamped on a carrier cylinder 1.3 if the carrier cylinder 1.3 bears an intermediate sleeve 20 (shown by thin lines in FIG. 2), on which the printing plate 16.4 is clamped. After the intermediate sleeve 20 has been pulled off axially d an intermediate sleeve 20.1 with a different external diameter has been pushed on, a printing plate 16.4 with a correspondingly different format can be clamped on the carrier cylinder 1. (see FIG. 6). The printing-plate sleeves 16, 16.1, 16.2, 16.4, 16.5 to be clamped on can be of seamless or seamed design. The printing plate can also be engraved directly into the surface of a carrier cylinder 1.4, for example as a gravure printing plate. Following the setting of an image, carrier cylinder 1.4 is then removed from the image-setting device and inserted into the printing unit of a printing machine. The various types of printing plates 16.1–16.5 carrier cylinders can be shown using like illustrations for purposes of the present invention. Accordingly, the item numbers for some of the alternative variants mentioned have been entered in brackets in the figures.

Further devices for printing-plate production can be set against the carrier cylinder 1, for example an erasing device 21, a fixing device 22 and/or an applicator device 23 for layers required for printing-plate production, these devices being shown schematically in FIG. 1.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. Apparatus for producing printing plates, comprising:

a frame arranged as a stand-alone structure external to a printing machine, a mounting arranged in said frame;

a carrier cylinder having a first end and a second end, said carrier cylinder being cantilever mountable at an image setting position on said mounting via said first end of said carrier cylinder;

a motor for driving said carrier cylinder, wherein said mounting includes a carrying tube fixed in said frame and a spindle mounted in said carrying tube, said spindle being connected to said carrier cylinder and said motor being arranged in said carrying tube and having a drive connection to said spindle;

an image setting device moveable along said carrier cylinder for setting an image on a blank printing plate arranged on said carrier cylinder, said second end of said carrier cylinder being freely accessible to permit printing plate change on said carrier cylinder; and an intermediate sleeve received on said carrier cylinder and arranged and dimensioned for receiving a printing plate that can be clamped onto said intermediate sleeve on said carrier cylinder, said intermediate sleeve being one of plural intermediate sleeves of different external diameter which are receivable on said carrier cylinder, wherein said carrier cylinder is replaceable by a further carrier cylinder having a different diameter, said image setting device being movable radially relative to a longitudinal axis of said carrier cylinder for accommodating the different diameters of said carrier cylinder and the further carrier cylinder.

2. The apparatus according to claim 1, wherein said motor is fixed in said frame and said carrier includes a journal, and said apparatus further comprises an external flexible belt drive connecting said motor to said journal of said carrier cylinder.

3. The apparatus according to claim 1, wherein said printing plate is a sleeve, said carrier cylinder having holes arranged in a cover thereof for blowing compressed air against a printing plate inner wall incident printing plate change.

4. The apparatus according to claim 1, wherein said carrier cylinder includes a clamping device for clamping a finite printing plate onto said carrier cylinder.

5. The apparatus according to claim 3, wherein said carrier cylinder is one of plural cylinders of different diameters which are each selectively mountable on said mounting at said image setting position.

6. The apparatus according to claim 4, wherein said carrier cylinder is one of plural cylinders of different diameters which are each selectively mountable on said mounting at said image setting position.

7. The apparatus according to claim 3, wherein said carrier cylinder is operative for selectively receiving printing plates of different diameters.

8. The apparatus according to claim 1, wherein said carrier cylinder is operative for receiving one of an offset printing plate, a letterpress printing plate, a flexographic printing plate, and a gravure printing plate.

9. The apparatus of claim 8, wherein a surface of said carrier cylinder comprises said gravure printing plate.

10. The apparatus of claim 1, further comprising a cross-member arranged in said frame parallel to an axis of rotation of said carrier cylinder, said image setting device being moveable on said crossmember.

11. The apparatus of claim 1, further comprising an erasing device arrangement which is settable set against said carrier cylinder.

12. The apparatus of claim 1, further comprising a fixing device arrangement which is settable against said carrier cylinder.

13. The apparatus of claim 1, further comprising a layer applicator device arrangement which is settable against said carrier cylinder.

14. The apparatus of claim 1, wherein said upper surface of said frame is a planar surface.

* * * * *